United States Patent [19]

Wong

[11] Patent Number: 4,735,153

[45] Date of Patent: Apr. 5, 1988

[54] LOAD SUPPORT AND HANDLING MEANS

[75] Inventor: Man K. Wong, North Point, Hong Kong

[73] Assignee: Wellman Industrial Co. Ltd., Hong Kong

[21] Appl. No.: 65,958

[22] Filed: Jun. 24, 1987

[30] Foreign Application Priority Data

Dec. 22, 1986 [GB] United Kingdom ..... 8630589

[51] Int. Cl.[4] ..... B65D 19/26

[52] U.S. Cl. ..... 108/51.1; 414/608

[58] Field of Search ..... 108/136, 51.1, 52.1, 108/54.1; 414/608; 248/677; 217/43 A; 220/69, 1.5; 206/598

[56] References Cited

U.S. PATENT DOCUMENTS

| | | | |
|---|---|---|---|
| 2,302,137 | 11/1942 | Neuman | 108/51.1 X |
| 2,702,682 | 2/1955 | Newsom . | |
| 3,167,038 | 1/1965 | Brown . | |
| 3,790,010 | 2/1974 | Stirling | 108/51.1 X |
| 4,065,014 | 12/1977 | Sagmiller | 414/608 |
| 4,230,050 | 10/1980 | Mays | 108/51.1 |
| 4,507,348 | 3/1985 | Nagata et al. | 108/51.1 X |
| 4,509,433 | 4/1985 | Farr . | |

FOREIGN PATENT DOCUMENTS

| | | |
|---|---|---|
| 8200081 | 9/1982 | PCT Int'l Appl. . |
| 0696214 | 8/1953 | United Kingdom . |

*Primary Examiner*—Peter A. Aschenbrenner

[57] ABSTRACT

A load support and handling means is provided in the form of a pallet (1). The pallet (1) includes a first, generally rectangular support surface (2) on which a load (3) to be handled can be placed, which first support surface (2) is made from semi stiff flexible sheet material. The pallet (1) also includes a second generally rectangular support surface (4) made from semi stiff flexible sheet material which underlies and is spaced from the first support surface (2). The second support surface (4) is intended to rest on a further support surface such as the ground. Also forming part of the pallet (1) are at least two elongated spacer members (6) in side by side spaced apart location between the first and second support surfaces (2, 4) at two opposed edge margins (2*b* and 4*a*) thereof to define therewith a central aperture (7) between the support surfaces (2, 4). Elastic connecting means in the form of rubber cords (8) elastically secure the first support surface (2) and space members (6) to the second support surface (4) so that with a load (3) on the first support surface (2) the minimum spacing between the surfaces (2,4) defined by the thickness of the spacer member (6) with the elastic connecting means rubber cords (8) fully contracted is sufficient to allow initial entry into the central aperture (7) of tapered leading ends of fork members (5) of a fork lift truck with further movement of the fork members (5) into the aperture (7) increasing the spacing between the surfaces (2, 4) by forcing the surfaces (2, 4)away from each other against the elastic return force of the expanded elastic connecting means rubber cords (8). Removal of the fork members (5) from the central aperture (7) allows the pallet (1) to retract to its minimum thickness once again by return of the surfaces (2,4) towards one another under the return action of the rubber cords (8).

8 Claims, 3 Drawing Sheets

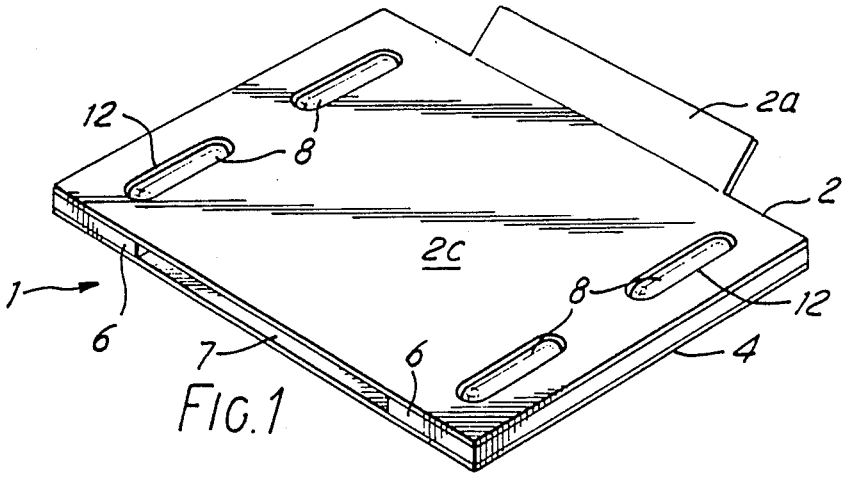
FIG. 1
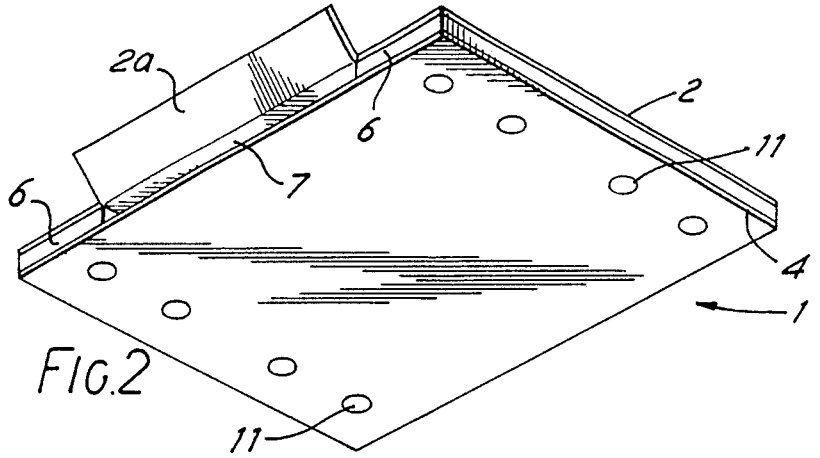
FIG. 2
FIG. 3
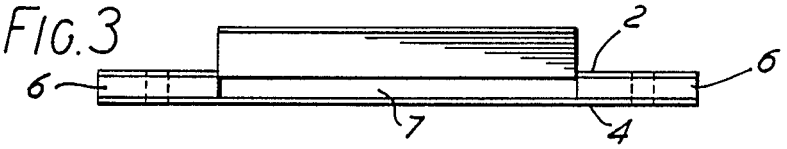
FIG. 4
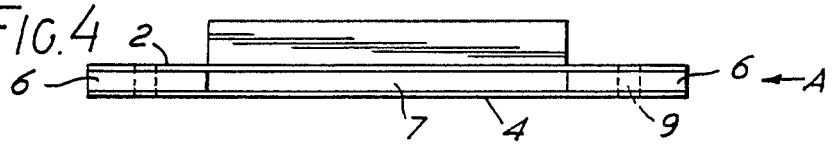
FIG. 5
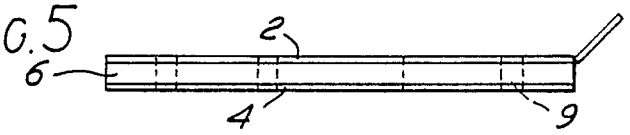

LOAD SUPPORT AND HANDLING MEANS

BACKGROUND OF THE INVENTION

1. Field of the Invention

This invention relates to a load support and handling means suitable for enabling a load to be carried or transported by a fork lift truck or like lift means.

2. Description of the Prior Art

Load support and handling means are known in the form of pallets made of wood, metal or fibre board. Such a conventional pallet made of wood generally comprises an upper support surface on which a load can be placed and a spaced apart lower support surface which can be rested on the ground or on the top of another load. For lifting purposes tapered ends of fork members of a fork lift truck are inserted in the fixed dimension space between the two support surfaces of the pallet. In continued use of the pallet with different fork lift trucks having different size fork lift members considerable damage can be caused to the pallet by continual contact with the fork lift members particularly if the dimensions, i.e. the thickness of the fork lift members is greater than the spacing between the two support surfaces of the pallet. This can lead to premature destruction of the pallet by breaking one or other of the support services away from the remainder of the pallet. To avoid this happening it is conventional for the pallet to be made with as wide a spacing as possible between the two support surfaces in order to enable use of the pallet with the majority of fork lift truck fork members. However this considerably increases the thickness of the pallet with consequent storage problems and reduction in space occupied by superimposed loads in a store. Additionally such a larger size pallet is more expensive to manufacture and heavier in weight. If the pallet is made from metal as an alternative to wood to avoid or reduce the problems of damage such a pallet is heavier and more expensive than the wooden version but less easy to damage but still has the problems of increased thickness with consequent reduction in storage space. Fibre board pallets are even more prone to damage than the wooden or metal versions although lighter in weight.

There is thus a need for a generally improved load support and handling means which is suitable for use with the majority of different size fork members of conventional fork lift trucks, which occupies as little space as possible and which is resistant to damage in use.

SUMMARY OF THE INVENTION

According to the present invention there is provided a load support and handling means including a first, generally rectangular, support surface on which a load to be handled can be placed, which first support surface is made from semi-stiff, flexible, sheet material, a second, generally rectangular, support surface also made from semi-stiff, flexible, sheet material, underlying and spaced from the support surface, which second support surface is intended to rest on a further support surface such as the ground, a vehicle floor or an upper face of stacked load, at least two elongated spacer members in side by side spaced apart location between the first and second support surfaces at two opposed edge margins thereof to define therewith a central aperture between the first and second support surfaces, and elastic connecting means elastically securing the first support surface and spacer members to the second support surface so that with a load on the first support surface the minimum spacing between the first and second support surfaces defined by the thickness of the spacer members, with the elastic connecting means fully contracted, is sufficient to allow initial entry into the central aperture between the first and second support surfaces and spacer members of tapered leading ends of fork members of a fork lift truck, with further movement of the fork members into the central aperture increasing the spacing between the first and second support surfaces by forcing the first and second support surfaces away from each other against the elastic return force of the expanded elastic connecting means, removal of the fork members from the central aperture allowing the first and second support surfaces to return under the return action of the contracting elastic connecting means to the minimum spacing, minimum thickness, contracted, rest position of the load support and handing means.

With such a construction of load support and handling means of the invention the ability for the spacing between the first and second support surfaces to vary between a minimum and a maximum enables the load support and handling means to be used with a variety of different thickness fork lift truck fork members without damage to the load support and handling means and with the means in the contracted rest position occupying the minimum of space in thickness thereby considerably improving the storage capacity of any system utilizing such a load support and handling means. Additionally the load support and handling means of the invention is comparatively light in weight and resistant to damage to a greater degree than a wooden or fibre board conventional construction. Moreover the elastic nature of the connecting means enables, in some instances, the support surfaces actively to grip an intervening fork lift truck fork member therebetween with improved safety in use as it tends to prevent the load support and handling means, and load thereon, slipping off the fork members during transit thereon or movement thereof.

Preferably the first and second support surfaces are made from Poly-Vinyl-Chloride (P.V.C) sheet material.

Advantageously the spacer members are made from Poly-Vinyl-Chloride (P.V.C) material.

Conveniently the elastic connecting means includes a plurality of lengths of rubber cord.

Preferably the elastic connecting means comprises four lengths of rubber cord, two per spacer member.

Advantageously each spacer member has four laterally spaced bores opening therethrough and extending in a direction transversed to the longitudinal axis of the spacer member between the first and second support surfaces, with each length of rubber cord being secured at one end to the second support surface, passing through one bore in the spacer member, through a corresponding hole through the first support surface, along a portion of the load supporting face of the first support surface, back through a further hole in the first support surface and through the corresponding aligned adjacent bore in the spacer member, and being secured at its other end to the second support surface.

Conveniently grooves are provided in the load supporting face of the first load support surface linking each hole in an associated pair, each of which grooves is sufficiently deep to accommodate the thickness of the associated length of rubber cord to prevent the latter being chafed by a load on said first support surface.

Preferably the spacer members are fixedly secured to the adjacent face of the first support surface, such as by adhesive or welding thereto.

THE DRAWINGS

For a better understanding of the present invention, and to show how the same may be carried into effect, reference will now be made, by way of example, to the accompanying drawings, in which:

FIG. 1 is a perspective view of a load support and handling means according to one embodiment of the invention viewed from above and the rear, FIG. 2 is a perspective of the means of FIG. 1 viewed from the front and below, FIG. 3 is an end view of the means of FIG. 1 and 2 viewed from the front, FIG. 4 is an end view of the means of FIGS. 1 to 3 viewed from the rear, FIG. 5 is a side view of the means of FIGS. 1 to 4 viewed in the direction A in FIG. 4, FIG. 6 is a generally exploded perspective view of the means of FIGS. 1 to 5, FIG. 7 is a general view from the side of the means of FIGS. 1 to 6 shown in operative association with a load and fork members of a fork lift truck with the means and load being in the course of transportation, FIG. 8 is a perspective view similar to that of FIG. 7 but showing the load being placed on the ground or like support surface with the fork members being withdrawn from the means, and FIG. 9 is a view similar to that of FIGS. 7 and 8 but showing the load resting on the means with the means in a minimum spacing, minimum thickness, contracted rest position.

DETAILED DESCRIPTION OF PREFERRED EMBODIMENT

Figure 6:
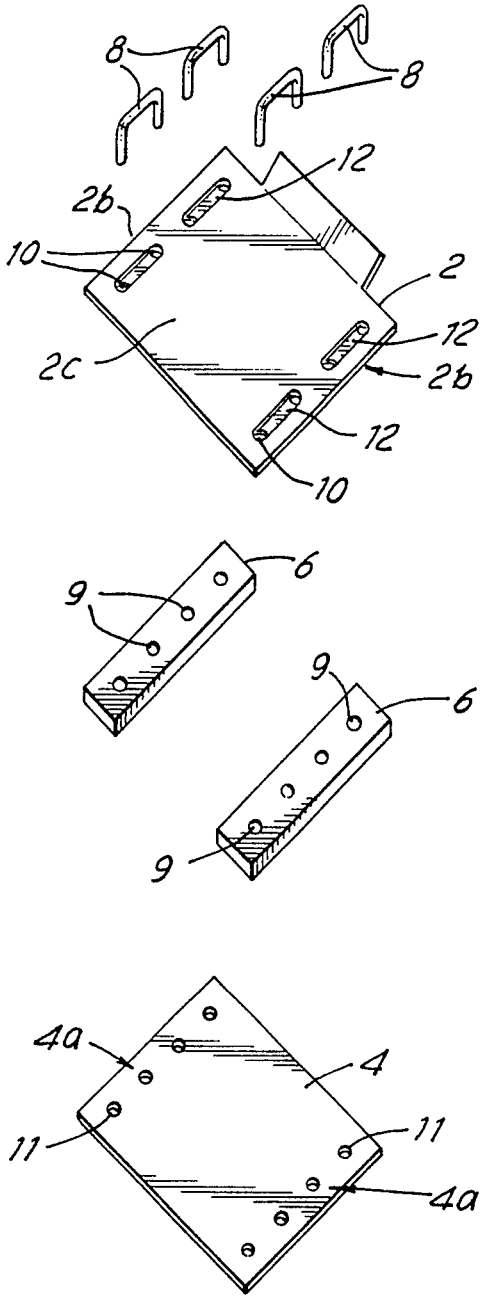

A load support and handling means of the invention as illustrate in FIGS. 1 to 9 of the accompanying drawings is intended for use in supporting a load in a manner such that the load and means can be moved with the aid of a fork lift truck. As shown in the accompanying drawings the load support and handling means according to one embodiment of the invention is in form of a pallet generally indicated at 1 which includes a first, generally rectangular, support surface 2 on which a load 3 to be handled can be placed. This first support surface 2 is made from semi stiff flexible sheet material such as Poly-Vinyl-Chloride (P.V.C.) sheet material.

The pallet 1 also includes a second, generally rectangular, support surface 4 also made from semi stiff flexible sheet material such as Poly-Vinyl-Chloride (P.V.C.) sheet material. The second support surface 4 underlies and is spaced from the first support surface 2 as can be seen specifically in FIGS. 1 to 5. The second support surface 4 is generally similar in shape to the first support surface 2 with the exception that the first support surface 2 includes a leading edge flap 2*a* to act as a means for manually dragging an empty unloaded pallet 1 or as a lead-in guide to the entrance of a fork lift fork member 5 as will be more particularly described later.

Figure 7:
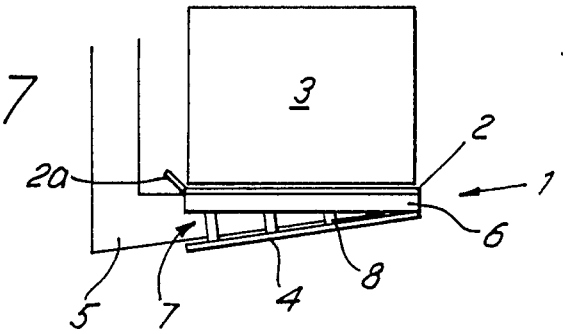

The second support surface 4 is intended to rest on a further support surface such as the ground, a vehicle floor or an upper face of a stacked load. The pallet 1 also includes at least two elongated spacer members 6, also preferably made from Poly-Vinyl-Chloride (P.V.C.) material, and arranged in side by side spaced apart location between the first and second support surfaces 2 and 4 at two opposed edge margins 2*b* and 4*a* thereof to define therewith a central aperture 7 between the first and second support surfaces 2 and 4 into which the fork members 5 can be inserted as shown in FIGS. 7 and 8.

Also forming part of the pallet 1 is elastic connecting means elastically securing the first support surface 2 and the spacer members 6 to the second support surface 4. The elastic connecting means conveniently is in the form of a plurality of lengths of rubber cord 8, preferably four such lengths as illustrated, 2 per space member 6. The rubber cords 8 are arranged such that the minimum spacing between the first and second support surfaces 2 and 4 defined by the thickness of the spacer members 6 with the elastic connecting means, that is the rubber cords 8, fully contracted, is sufficient to allow initial entry into the central aperture 7 between the first and second support surfaces 2 and 4 and spacer members 6 of tapered leading ends of the fork members 5 of a fork lift truck. Further movement of the fork member 5 into the central aperture 7 increases spacing between the first and second support surfaces 2 and 4 as shown in FIG. 7 by forcing the first and second support surfaces 2 and 4 away from each other against the elastic return force of the expanded elastic connecting means, that is the rubber cord 8. This is the position in which the load 3 on the pallet 1 is being carried on the fork members 5 as shown in FIG. 7 and represents the maximum expanded position of the pallet 1 in which the under surfaces of the support surfaces 2 and 4 grip tightly against the inserted fork member 5 thus enhances safety of the pallet by enabling it to grip the carrying fork members 5 during transit as shown in FIG. 7.

Figure 8:
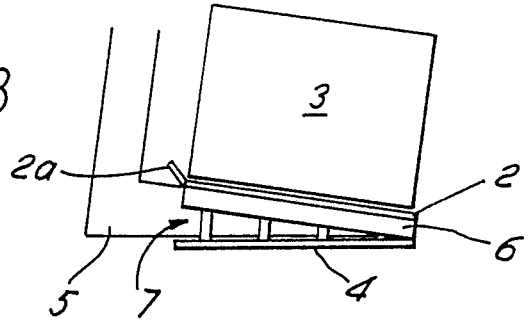
Figure 9:
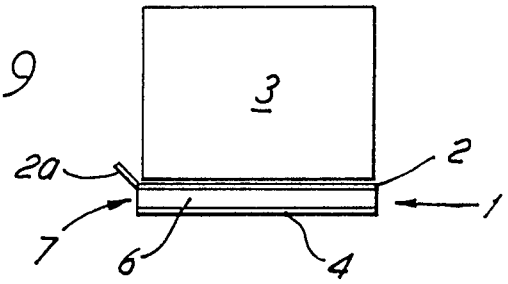

Removal of the fork members 5 from the central aperture 7, with the pallet on the ground or on the upper surface of a stacked load as shown in FIG. 8 allows the first and second support surfaces 2 and 4 to return under the return action of the contracting elastic connecting means rubber cords 8 to the minimum spacing, minimum thickness, contracted rest position of the load support and handling means pallet 1 as shown in FIG. 9. In this position the pallet 1 occupies the minimum space and has its minimum thickness thus increasing the storage capacity of the area in which loads are being stored.

As shown in the drawings, particularly in FIG. 6, each spacer member 6 has four laterally spaced bores 9 therethrough which extend in a direction transverse to the longitudinal axis of the spacer member 6 between the first and second support surfaces 2 and 4. Each length of rubber cord 8 is secured at one end to the second support surface 4, passes through one bore 9 in the spacer member 6, through a corresponding hole 10 through the first support surface 2, along a portion of the load supporting face 2*c* of the first support surface 2, back through a further hole 10 in the first support surface 2 and through the corresponding aligned adjacent bore 9 in the spacer member 6. The rubber cord 8 is secured at its other end to the second support surface 4. Conveniently to this end the second support surface 4 is provided with eight holes 11 therethrough into which the ends of the rubber cord 8 are secured either by adhesive or by welding.

Grooves 12 are provided in the load supporting face 2*c* of the first load support surface 2 linking each hole 10 in an associated pair as can be seen in FIG. 6. Each of these grooves 12 is sufficiently deep to accommodate the thickness of the associated length of rubber cord 8 to prevent the latter being chafed by a load 3 on the first support surface 2. The spacer members 6 may be fixedly secured to the adjacent face of the first support surface 2, such as by adhesive or welding thereto, with the result shown in FIGS. 7 and 8 that they adhered to the first support surface 2 when the second support surface 2 is displaced therefrom to the limit permitted by the rubber cords 8 on insertion of the fork members 5.

As can be seen from FIGS. 7, 8 and 9 the pallet 1 of the invention occupies a minimum thickness in the contracted rest position supporting a load 3 as illustrated in FIG. 9. When fork members 5 are inserted into the central aperture 7 this aperture increases in depth to the amount required to accommodate the thickness of the fork members 5 as can be seen in FIGS. 7 and 8. In this way a pallet can be provided which occupies minimum space in a stacked or storage position but which can accommodate large thickness fork members 5. This allows the use of less material for constructing the pallet 1 with consequent saving in cost.

By using P.V.C. material for the majority of the pallet it can be made light and sufficiently flexible to absorb impact without damage, which impact would otherwise damage and destroy a wooden, fibre board or metal pallet. Additionally because of the use of P.V.C. the pallet of the invention is light in weight, can easily be handled manually when unloaded, if necessary, and is of improved safety in that it does not have sharp metal edges or splintered wooden edges which can cause harm to a user. Additionally the resilient nature of the rubber cords 8 allows the pallet 1 to grip tightly an inserted fork member 5 during transport with consequent safety improvement.

What is claimed is:

1. A load support and handling means, including a first, generally rectangular, support surface on which a load to be handled can be placed, which first support surface is made from semi-stiff, flexible, sheet material, a second, generally rectangular, support surface, also made from semi-stiff, flexible, sheet material, underlying and spaced from the first support surface, which second support surface is intended to rest on a further support surface such as the ground, a vehicle floor or an upper face of a stacked load, at least two elongated spacer members in side by side spaced apart location between the first and second support surfaces at two opposed edge margins thereof to define therewith a central aperture between the first and second support surfaces, and elastic connecting means elastically securing the first support surface and spacer members to the second support surface so that with a load on the first support surface the minimum spacing between the first and second support surfaces defined by the thickness of the spacer members, with the elastic connecting means fully contracted, is sufficient to allow initial entry into the central aperture between the first and second support surfaces and spacer members of tapered leading ends of fork members of a fork lift truck, with further movement of the fork members into the central aperture increasing the spacing between the first and second support surfaces by forcing the first and second support surfaces away from each other against the elastic return force of the expanded elastic connecting means, removal of the fork members from the central aperture allowing the first and second support surfaces to return under the return action of the contracting elastic connecting means to the minimum spacing, minimum thickness, contracted, rest position of the load support and handling means.

2. A load support and handling means according to claim 1, wherein the first and second support surfaces are made from Poly-Vinyl-Chloride (P.V.C) sheet material.

3. A load support and handling means according to claim 1, wherein the spacer members are made from Poly-Vinyl-Chloride (P.V.C) material.

4. A load support and handling means according to claim 1, wherein the elastic connecting means includes a plurality of lengths of rubber cord.

5. A load support and handling means according to claim 4, wherein the elastic connecting means comprises four lengths of rubber cord, two per spacer member.

6. A load support and handling means according to claim 5, wherein each spacer member has four laterally spaced bores opening therethrough and extending in a direction transversed to the longitudinal axis of the spacer member between the first and second support surfaces, with each length of rubber cord being secured at one end to the second support surface, passing through one bore in the spacer member, through a corresponding hole through the first support surface, along a portion of the load supporting face of the first support surface, back through a further hole in the first support surface and though the corresponding aligned adjacent bore in the spacer member, and being secured at its other end to the second support surface.

7. A load support and handling means according to claim 6, wherein grooves are provided in the load supporting face of the first load support surface linking each hole in an associated pair, each of which grooves is sufficiently deep to accommodate the thickness of the associated length of rubber cord to prevent the latter being chafed by a load on said first support surface.

8. A load support and handling means according to claim 7, wherein the spacer members are fixedly secured to the adjacent face of the first support surface, such as by adhesive or welding thereto.

* * * * *